US009788574B2

(12) United States Patent
Mullen et al.

(10) Patent No.: US 9,788,574 B2
(45) Date of Patent: Oct. 17, 2017

(54) DEVICE FOR CONSECUTIVE CONSUMPTION OF LIQUID FROM CONTAINER AND SMOKE

(71) Applicants: Alex Mullen, Ottawa (CA); Pierre Wilder, Ottawa (CA); Jeffery Bebee, Port Hope (CA)

(72) Inventors: Alex Mullen, Ottawa (CA); Pierre Wilder, Ottawa (CA); Jeffery Bebee, Port Hope (CA)

(73) Assignees: Alex Mullen, Comber (CA); Jeffery Bebee, Port Hope (CA)

( * ) Notice: Subject to any disclaimer, the term of this patent is extended or adjusted under 35 U.S.C. 154(b) by 1021 days.

(21) Appl. No.: 14/014,704

(22) Filed: Aug. 30, 2013

(65) Prior Publication Data

US 2014/0083520 A1 Mar. 27, 2014

(30) Foreign Application Priority Data

Sep. 27, 2012 (CA) ..... 2791023

(51) Int. Cl.
*A24F 3/00* (2006.01)
*A24F 1/30* (2006.01)
*A24F 19/00* (2006.01)

(52) U.S. Cl.
CPC ..... *A24F 3/00* (2013.01); *A24F 1/30* (2013.01); *A24F 19/00* (2013.01); *Y10T 137/2931* (2015.04)

(58) Field of Classification Search
CPC ..... A47G 19/2266; G01F 1/40; A24F 5/10; B65D 51/1611
USPC .... 222/481.5, 478, 479, 481, 483, 499, 500, 222/522; 239/333; 131/270, 330, 173, 131/180, 182, 183, 196, 205, 206, 215.1, 131/215.2, 215.3, 216, 222, 223, 224, 225
See application file for complete search history.

(56) References Cited

U.S. PATENT DOCUMENTS 1,245,078 A * 10/1917 Westinfield ..... A24F 5/10 131/176
1,249,984 A * 12/1917 Meissner ..... A24F 1/30 131/173

(Continued)

FOREIGN PATENT DOCUMENTS

GB 1493109 * 11/1977

*Primary Examiner* — Joseph S Del Sole
*Assistant Examiner* — Manley Cummins, IV
(74) *Attorney, Agent, or Firm* — Greer, Burns & Crain, Ltd.

(57) ABSTRACT

A device for use with a container containing liquid and having an opening for the consecutive consumption of the liquid and of smoke that has been drawn into the container. The device comprises a body, a combustion receptacle, and a tubular structure. An inlet end of the body engages the container, and an outlet end can be placed at the mouth of a user. The tubular structure connects the combustion receptacle with the interior of the liquid container. When smoking material is combusted and the container is inverted, outflow of liquid from the container through the body, in most instances into a user's mouth, creates negative pressure within the container, drawing in smoke from the combustion receptacle. Once most or all of the liquid has flowed out of the container, the user may then inhale the smoke in the container through the body.

21 Claims, 10 Drawing Sheets

(56) References Cited

U.S. PATENT DOCUMENTS

| | | | | | |
|---|---|---|---|---|---|
| 4,148,327 | A * | 4/1979 | Graham | A24F 1/30 | 131/173 |
| 4,161,954 | A | 7/1979 | Fornaciari | | |
| 4,198,993 | A | 4/1980 | Martin et al. | | |
| 4,967,922 | A * | 11/1990 | Alder | B65D 47/06 | 215/309 |
| 5,964,382 | A * | 10/1999 | Randal | B65D 51/1611 | 222/478 |
| 6,073,632 | A | 6/2000 | Tolja | | |
| 7,784,361 | B2 * | 8/2010 | Wiedmann | G01F 1/40 | 73/861.52 |
| 2009/0120968 | A1 | 5/2009 | Lard, II et al. | | |
| 2011/0233236 | A1 * | 9/2011 | Brown | A47G 19/2266 | 222/481 |

* cited by examiner

DEVICE FOR CONSECUTIVE CONSUMPTION OF LIQUID FROM CONTAINER AND SMOKE

CROSS-REFERENCE TO RELATED APPLICATION

The present application claims priority to Canadian Patent Application No. 2,791,023, having a filing date of Sep. 27, 2012, the entire contents of which are incorporated herein by reference.

FIELD OF THE DISCLOSURE

The present disclosure relates generally to drinking and smoking devices, and more particularly to a device for the consecutive consumption of liquid from a container and of smoke.

BACKGROUND

Various types of devices and apparatuses exist for consuming drinkable liquids. These include funnels, beer funnels, beer bongs, and other chugging devices, such as those that vent a container to accelerate the discharge of liquid therefrom, etc. The activity known as "beer chugging" is particularly popular amongst college and university students and various other young adult demographics. The goal of the activity is for the user to consume a quantity of beer as rapidly as possible, often in competition with other users. The most common beer containers used in the activity are open-lid funnels or aluminum cans with additional holes punctured by the user, both of which provide an inlet for air to replace the expelled beer in the container. However, with beer bottles, the lack of a second opening for air supply results in slow, pulsing dispensing of the beer.

In addition, various types of devices and apparatuses exist for smoking smokable material, such as tobacco and other organics. These include pipes, water pipes and hookahs, among others. Some of these devices provide various benefits including a container for the material to be smoked. Some devices also provide a cooling effect as the smoke travels through a volume of liquid.

Furthermore, some devices exist that combine the act of drinking liquid with the act of smoking.

However, a need exists for a device that can provide for the consecutive consumption of liquid from a container and then of smoke.

SUMMARY

In one aspect, the present disclosure provides a device for use with a liquid container having an opening and containing liquid, the device comprising: a body having an inlet end and an outlet end, and defining a fluid passage between the inlet end and the outlet end, the inlet end being substantially sealingly engageable with the container to provide fluid communication between the opening of the container and the fluid passage of the body, the body further defining an opening therethrough, the opening being different than the fluid passage; a combustion receptacle for receiving smokable material, and for allowing the combustion of the smokable material therein; and a tubular structure for allowing the travel of smoke from the combustion receptacle into the container, the tubular structure having a first end and a second end and extending at least from the opening in the body outwardly from the inlet end of the body, the first end being in fluid communication with the combustion receptacle, and the second end extending into the container when the device is engaged with the container.

BRIEF DESCRIPTION OF THE DRAWINGS

The present disclosure will be better understood having regard to the drawings in which.

DETAILED DESCRIPTION

Figure 1:
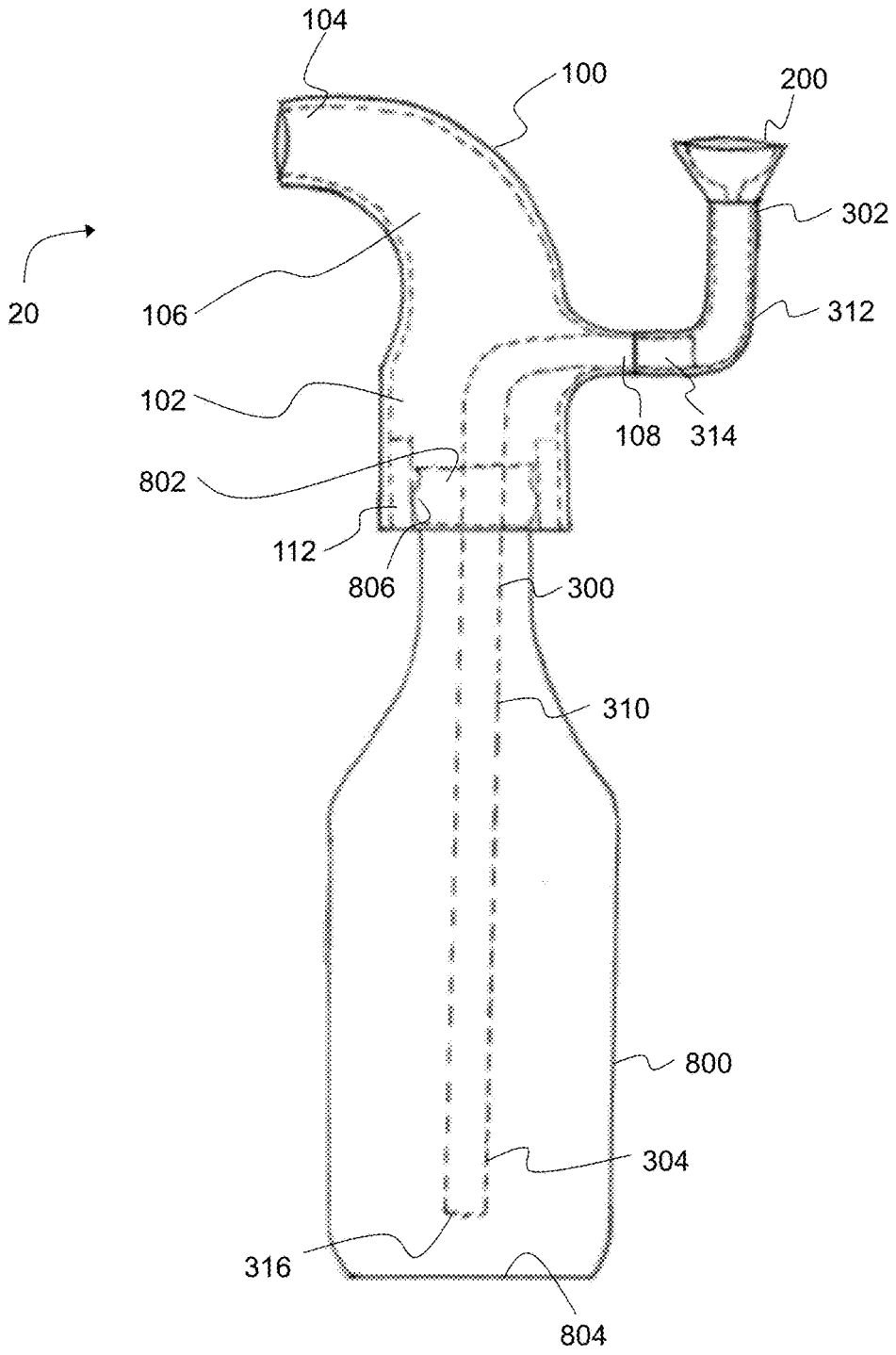
FIG. 1 is a side view of one embodiment of the present device shown in an upright orientation.

In one aspect, the present disclosure provides a device for the consecutive consumption of liquid from a container and of smoke that has been drawn into the container as the liquid flowed out of the container.

In one aspect, the present disclosure provides a device for use with a container containing liquid and having an opening. The device generally comprises a body, a combustion receptacle, and a tubular structure. The body has an inlet end that can engage the container, and an outlet end that can be placed at the mouth of a user. Thus when the container is inverted, liquid in the container can flow through the body into the mouth of the user. The tubular structure provides for fluid communication between the combustion receptacle and the interior of the liquid container, for example, to allow smoke to travel from the receptacle into the container. When smoking material, such as tobacco, in the combustion receptacle is combusted and the container is inverted, the outflow of liquid from the container through the body creates negative pressure within the container, thereby drawing in smoke from the combustion receptacle through the tubular structure. In some instances, the drawing of smoke and air into the tubular structure can further enhance the combustion of the smokable material as at the same time air, and thus oxygen, is sucked into the combustion receptacle. Once most or all of the liquid has flowed out of the container, the user may then inhale the smoke in the container through the body. In this way, the present device can provide for the consecutive consumption of liquid from a container and of smoke that has been drawn into the container.

In another aspect, the tubular structure extends to or proximate a bottom surface of a container when the device is engaged with the container so that when the container is inverted and smoke is drawn into the container, the amount of smoke that passes through the liquid as it exits the tubular structure is minimized.

In another aspect, the present disclosure provides a device comprising a one-way valve mechanism for preventing travel of the liquid in the container into the combustion receptacle but allowing for the travel of fluid, for example smoke, from the combustion receptacle into the container.

In another aspect, the present disclosure provides a device wherein the orientation of a combustion receptacle is substantially maintainable as the container is moved between a non-inverted orientation and an inverted orientation.

In yet another embodiment, the present disclosure provides a device wherein the distance by which the tubular structure extends outwardly from the inlet end of the body is selectively adjustable. In other words, the distance by which the tubular structure extends outwardly from the device into a container can be selectively adjustable.

While the embodiments described and illustrated herein are adapted to engage a container having a neck, the scope of the present disclosure is not intended to be limited to this type of container. The present device can be adapted for use with other types of containers, including but not limited to containers with smaller and larger necks, containers without necks, cans, glass bottles, metallic bottles and plastic bottles.

In addition, the term "inverted" is used herein to describe orientations of a container. The term is not used in a strict sense, but rather it is used to mean that the container is orientated such that any liquid in the container will flow out of the container as a result of gravity.

The various features and components of the present device are now described with reference to the Figures.

FIG. 1 shows one embodiment of the present device 20 engaged with a liquid container 800, here in the form of bottle having a neck. The container is shown in an upright position. In this embodiment, device 20 generally comprises body 100, combustion receptacle 200, and tubular structure 300. Body 100 comprises inlet end 102, outlet end 104, and defines fluid passage 106 extending between the inlet and outlet ends, 102 and 104, respectively. Inlet end 102 can be adapted for engagement with container 800 at a portion of the container 806 that is adjacent a container opening 802. In this embodiment, inlet end 102 is disposed over and around portion 806 of the container. However, the device may be adapted to engage container 800 in other ways. For example, inlet end 102 can abut a rim of the container. In other embodiments, inlet end 102 can be adapted to be received into container opening 802. Other types of engagements of the device to a container are possible.

Furthermore, in one or more embodiments, device 20 can be releasably connectable to the container in any suitable way, including but not limited to a friction-fit connection, a snap-fit connection, and a screw-on connection. In at least one embodiment, the releasable connection is sufficiently strong to retain the connection during use of the device. In the embodiment of FIG. 1, body 100 is releasably connected to container 800 by way of a friction fit. Inlet end 102 is positioned over and around end portion 806 of the container and the inner surface or surfaces of inlet let 102 can frictionally engage end portion 806 of the container.

Figures 7A, 7B, 7C:
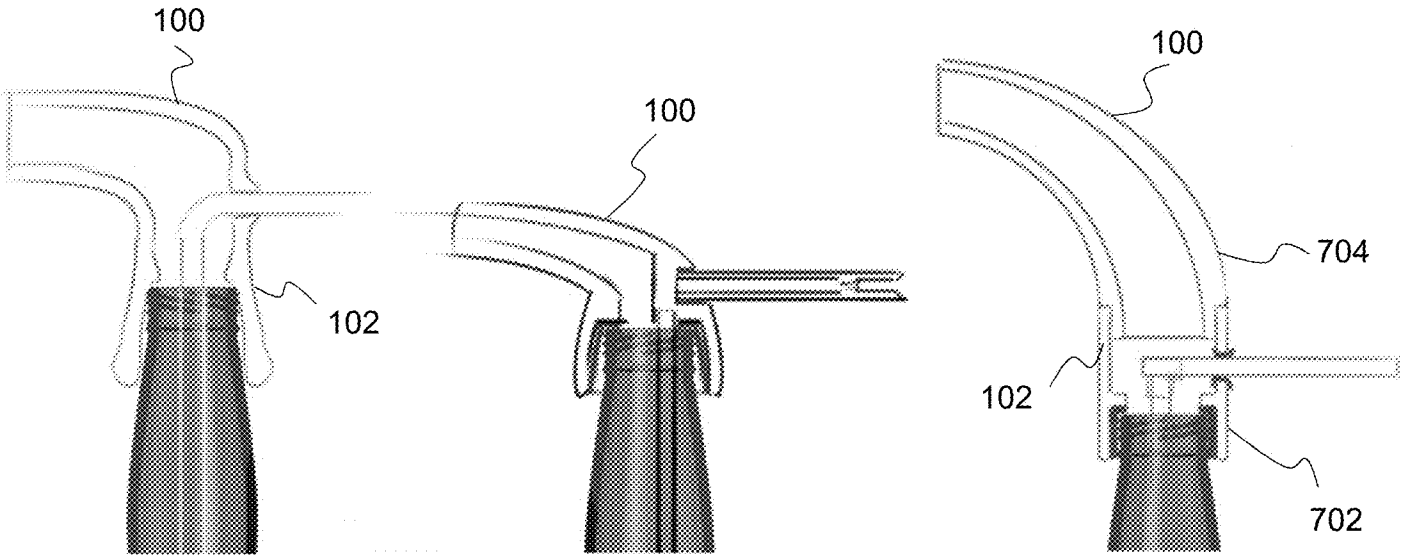
FIGS. 7A to 7C show various possible ways of releasably connecting different embodiments of the present device to a container.

Device 20 may be releasably connected to container 800 in other ways. For example, FIGS. 7A to 7C show various other possible ways. FIG. 7A shows an embodiment wherein at least inlet end 102 of body 100 is made of flexible material for providing a friction fit releasable connection to the container. The flexible material may also serve as a fluid seal between the body and the container. The at least inlet end 102 can be made of any suitable flexible material, including an elastomer material. In one or more embodiments, most or all of body 100 can be made of flexible material. FIG. 7B shows an embodiment wherein inlet end 102 can be made of a firm material and comprises a flexible material disposed around its inner surface for engaging end 806 of the container to provide for a friction fit. FIG. 7C shows another embodiment wherein inlet end 102 is also made of a firm material and comprises a flexible material disposed around its inner surface. In addition, in this embodiment, body 100 comprises two portions, namely first portion 702 and second portion 704, which can be joined in any suitable way.

Figure 8A:
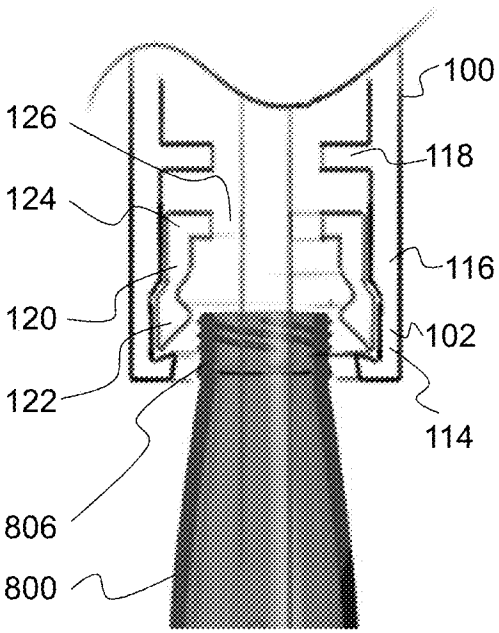
FIGS. 8A to 8C show cross sectional views of the inlet end of the body of another embodiment of the present device, the inlet end comprising a gripping mechanism for providing a releasable connection with a container.
Figure 8B:
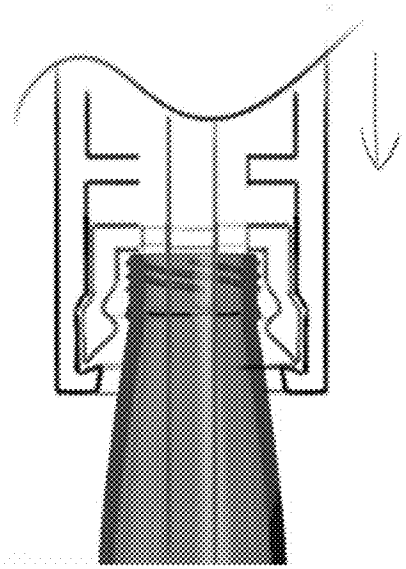
Figure 8C:
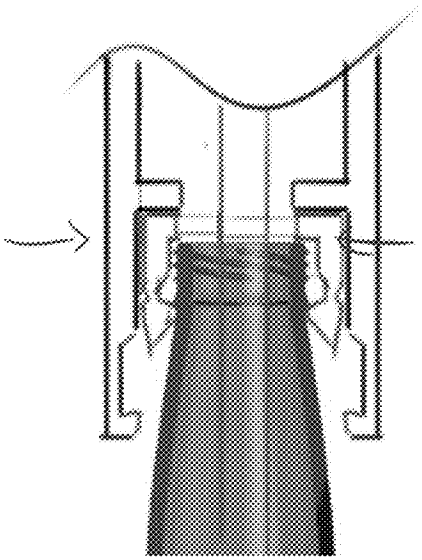

FIGS. 8A to 8C show another embodiment having another type of releasable connection between device 20 and a container. In this embodiment, device 20 comprises a moveable gripping mechanism 120 disposed at the inlet end 102 of body 100. Gripping mechanism 120 can be adapted to receive end 806 of the container 800, and in at least one embodiment can fully surround end 806. Gripping mechanism 120 can move within inlet end 102 between a release position shown in FIG. 8A and a gripping engagement position shown in FIG. 8C. In the release position, distal portion 122 of gripping mechanism 120 is disposed in a larger inner portion 114 of inlet end 102 of the body, allowing end 806 of the container to be easily received into inlet end 102. As device 20 and container 800 are moved towards one another, the container contacts gripping mechanism 120 and pushes it inwardly within body 100, as shown in FIG. 8B. As gripping mechanism 120 is moved inwardly, distal portion 122 moves from larger inner portion 114 of inlet end 102 to smaller inner portion 116 of inlet end 102 causing distal portion 122 to be squeezed towards end 806 of container 800. Body 100 can comprise a stop mechanism, such as lip 118, to prevent further inward movement of gripping mechanism 120. The squeezing of distal portion 122 towards the container can cause mechanism 120 to grip and retain container end 806 within inlet end 102 of the body of the device. In addition, gripping mechanism 120 can comprise at least one opening or passage 126 therethrough to allow for the passage of tubular structure 300 from body 100 into the container and also for allowing liquid and smoke to flow out of the container into body 100. Furthermore, gripping mechanism 120 can also serve as a seal between body 100 and container end 806.

In addition, the device may provide for a sealing fit of inlet end 102 to the container 800. For example, the device may comprise one or more types of sealing at inlet end 102 to provide a fluid tight seal between body 100 and container 800. As shown in FIG. 1, in at least one embodiment, the sealing can be in the form of flexible sealing 112 disposed within inlet end 102 of the body. However, it is to be appreciated that sealing can take other forms and can be positioned at other suitable locations at inlet end 102 of the body.

Outlet end 104 is located at the opposite end of body 100 relative to inlet end 102 and can be adapted for contact with a mouth of a user. As shown in the Figures, in one or more embodiments, body 100 can be curved or angled such that outlet end 104 is orientated at a different angle than inlet end 102. Having a curved or angled body 100 can make the device more ergonomic to use. For example, outlet end 104 can be orientated relative to inlet end 102 such that a user can put their mouth to outlet end 104 and maintain their head in substantially the same position as they move the container from an upright position to an inverted position. For example, as shown in the Figures, in at least one embodiment, outlet end 104 can be substantially perpendicular to inlet end 102. For instance, a user can put his or her mouth to outlet end 104 to the embodiment shown in FIGS. 1 and 2. The user need not move his or her head as the container is moved between an upright orientation shown in FIG. 1 and an inverted orientation shown in FIG. 2. In one or more other embodiments, the curvature or angle of body 100 can be greater or lesser than that the curvature or angle of those shown in the Figures.

Figure 5A:
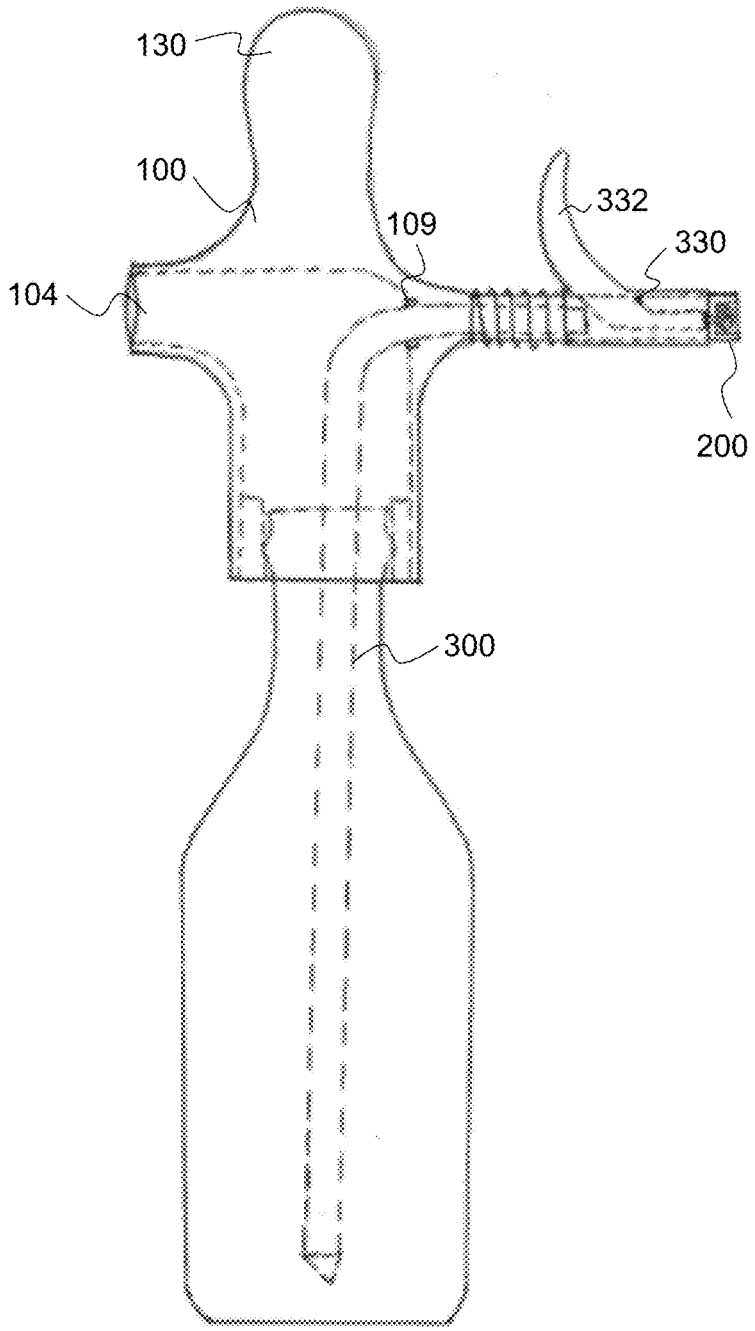
FIG. 5A is a side view of another embodiment of the present device comprising a shotgunning valve mechanism.
Figure 6:
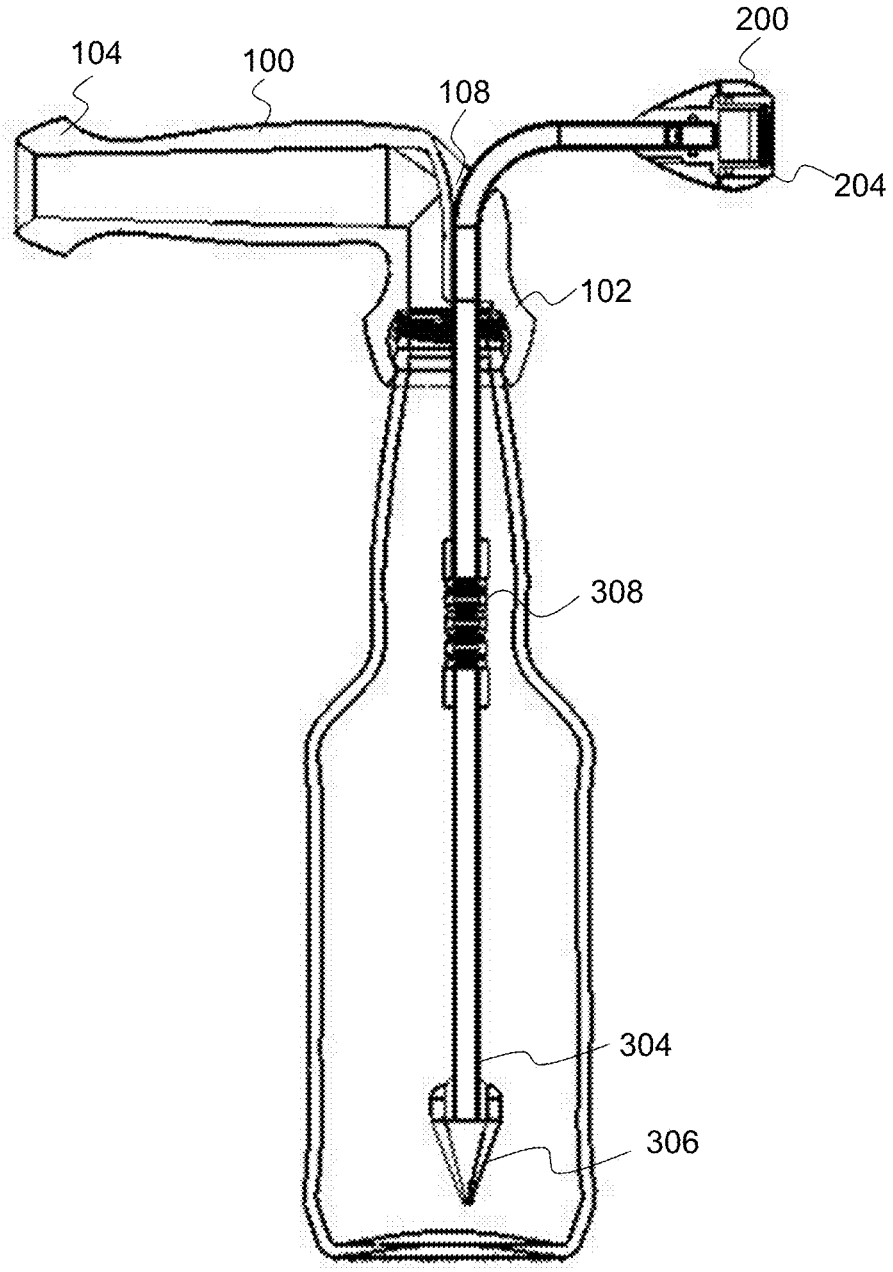
FIG. 6 is a side view of another embodiment of the present device.

FIGS. 5A, 6 and 7A to 7C show various other embodiments of body 100. Body 100 of the embodiment shown in FIG. 5A defines a handle portion 130, which can be useful in embodiments of device 20 that have a shotgunning valve mechanism 330. As will be described in more detail below, shotgunning valve mechanism 330 can be used for selectively closing and opening the fluid passageway defined by tubular structure 300. Handle portion 130 can be used to hold and stabilize device 20 when trigger 332 of shotgunning valve mechanism 330 is actuated. FIG. 6 shows another embodiment having yet another type of body 100, where body 100 is more in the shape of a right angle than a curve. FIGS. 7A to 7C show various other embodiments of body 100. The bodies explained herein and shown in the Figures are merely examples and are not meant to be limiting.

Outlet end 104 can further comprise or be adapted to receive a removable mouthpiece (not shown). A removable mouthpiece can be used for health purposes, for example by a user who does not wish to share saliva with one or more other users of the device.

As shown in FIG. 1, body 100 can also comprise an opening 108 for allowing smoke from combustion receptacle 200 and/or air to enter into container 800. As mentioned above, device 20 comprises tubular structure 300, which can have first and second ends, 302 and 304, respectively. First end 302 can be connected to or otherwise extend from combustion receptacle 200 and second end 304 can extend into a container when the device is engaged with the container. As shown in FIGS. 1 to 4A, 5A and 6, in at least one embodiment, tubular structure 300 can extend at least from opening 108 in body 100, through body 100 in an outward direction from inlet end 102 of the body. When the device is engaged to a container, tubular structure 300 extends outwardly from body 100 in the direction of inlet end 102 into the container. First end 302 of tubular structure 300 can be located at opening 108, or, as shown in the Figures, tubular structure 300 can extend through opening 108 outwardly from body 100 such that first end 302 is located outwardly and away from opening 108. Sealing can be provided at opening 108 to provide a fluid tight seal between tubular structure 300 and body 100. In at least one embodiment, sealing can comprise or consist of silicone, which has a high temperature tolerance and does not cause negative off-gassing. In some embodiments, first end 302, and therefore combustion receptacle 200, is disposed outwardly and away from opening 108, and therefore away from body 100, for example to make it easier for a user to apply a flame or other heat or ignition source to combustion receptacle 200. Such a positioning of first end 302 and combustion receptacle 200 can also increase the safety of the device since the combusting smokable material and an applied flame or other ignition source will be located away from the face of a user during use of the device.

In addition, when body 100 is curved or angled, combustion receptacle 200 can be disposed on an opposite or different side of body 100 relative to the direction in which outlet end 104 extends. In this way, combustion receptacle 200 can be positioned away from the face of a user when the device is being used.

Figure 2:
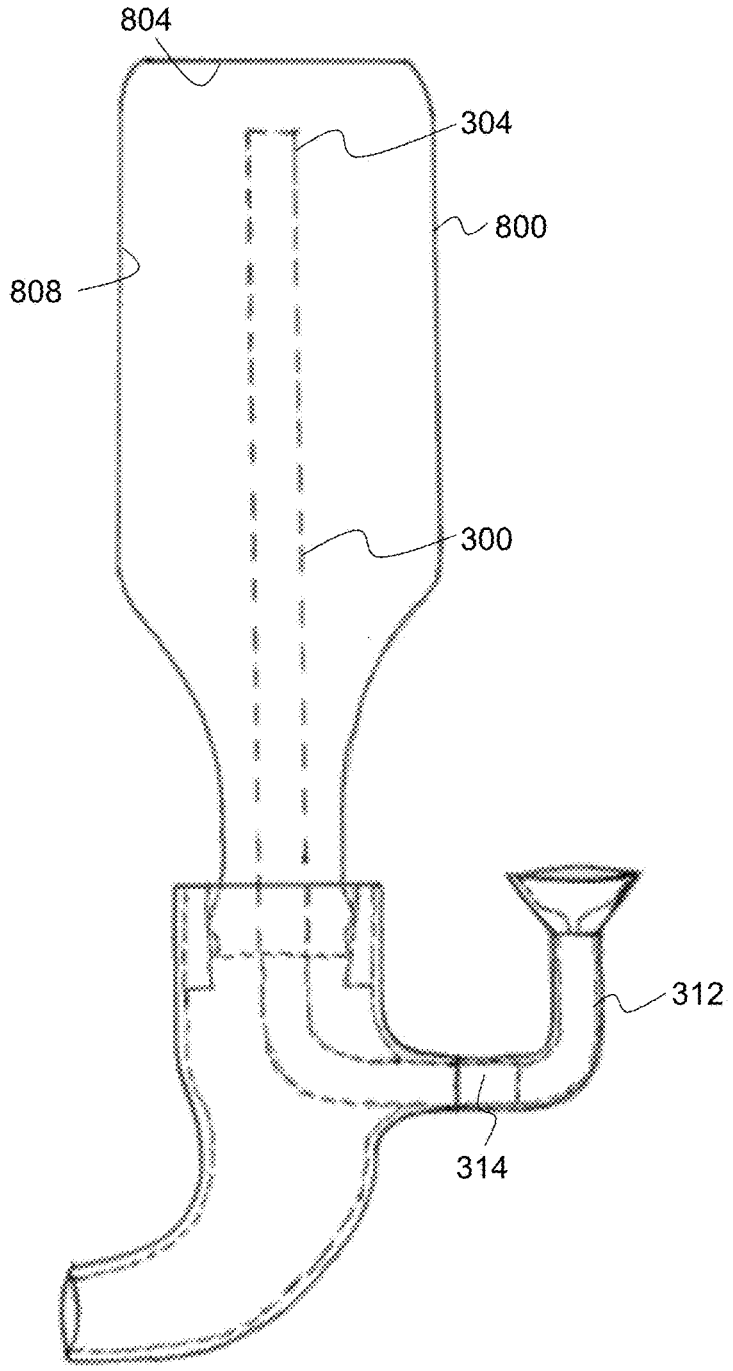
FIG. 2 is a side view of the embodiment of FIG. 1 shown in an inverted orientation.
Figure 3:
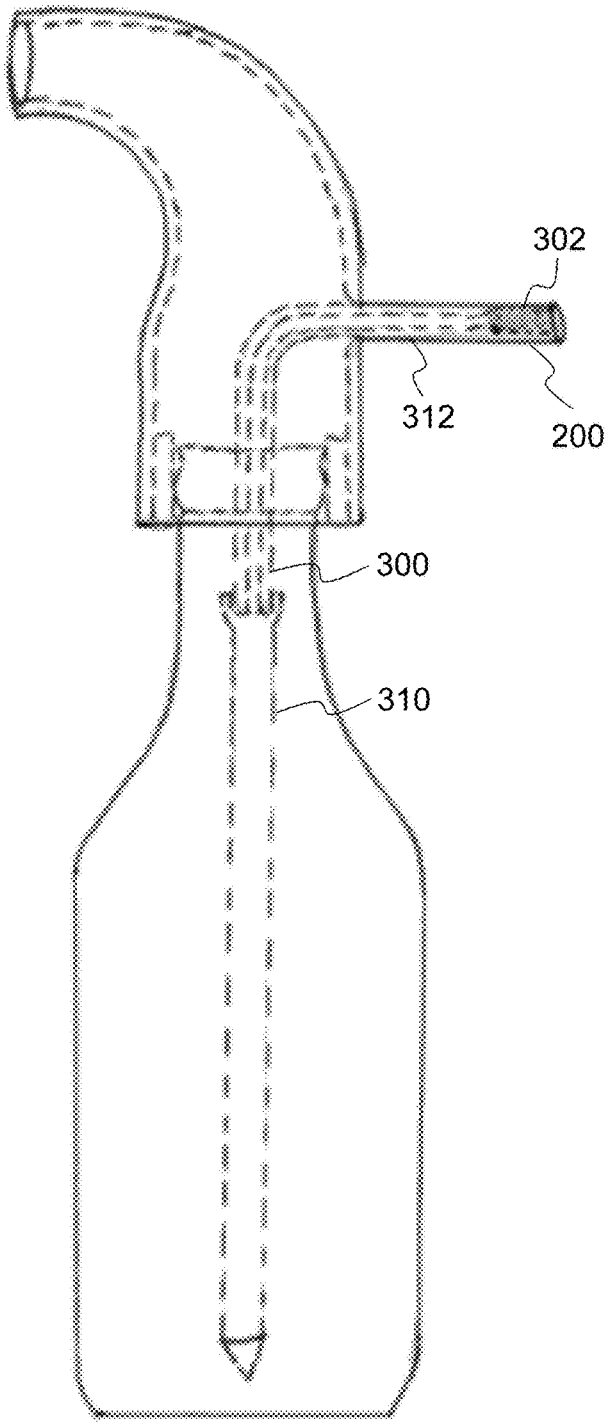
FIG. 3 is a side view of another embodiment of the present device.

As described above, device 20 comprises tubular structure 300 for providing fluid communication between combustion receptacle 200 and the interior of a container. In one or more embodiments, as shown in the Figures, combustion receptacle 200 can be disposed on the exterior of body 100. In these one or more embodiments, tubular structure 300 can therefore extend out of body 100 through opening 108. The shape, length, orientation, and material from which the portion of the tubular structure that extends out of the body can depend on several considerations, including the type of combustion receptacle that is being used in the device. For example, in the embodiment shown in FIGS. 1 and 2, combustion receptacle 200 is an open top or open ended receptacle. Therefore in most instances, it will be desirable to maintain receptacle 200 in a substantially upright orientation so that any smokable material disposed therein will not fall out. To achieve this result, in this embodiment tubular structure 300 comprises at least first and second tubular portions, 310 and 312, respectively. At least part of second tubular portion 312 extends outwardly of body 100. Second tubular portion 312 can be rotatably and sealingly engaged to first tubular portion 310 at any suitable location. As shown in FIGS. 1 and 2, first and second tubular portions 310 and 312 are engaged at engagement region 314, which is located proximate to opening 108 in body 100. Accordingly, during use of the device, second tubular portion 312 and thus combustion receptacle 200 can be maintained in a substantially upright orientation, for example manually by a user. As the container is moved from an upright orientation (e.g. FIG. 1) to an inverted orientation (e.g. FIG. 2), second tubular portion 312 and combustion receptacle 200 can be held in a substantially upright orientation.

In one or more embodiments, second tubular portion 312 can be releasably connected to first tubular portion 310. This can be useful during use of the device, for example, when a user has consumed most or all of the liquid and is attempting to clear out (e.g. inhale) the smoke from the container. The detachment of second tubular portion 312 can increase the airflow into the container and thereby assist in venting the container. A detachable second tubular portion 312 can also be useful when cleaning device 20, or for disassembling the device for storage or transport.

In at least another embodiment, rather than or in addition to tubular structure 300 comprising a rotatable engagement between at least two tubular portions, the portion of tubular structure 300 that extends between body 100 and combustion receptacle 200 can be flexible, thereby allowing combustion receptacle 200 to be maintained in an upright orientation during use.

In at least another embodiment, as shown in FIGS. 3 to 6, the portion of tubular structure 300 that extends between body 100 and combustion receptacle 200 can extend straight out from body 100 such that it is more or less perpendicular to a longitudinal axis of a container to which the device can be engaged. In such embodiments, combustion receptacle 200 can be capable of retaining smoking material within the receptacle as a container is moved between upright and inverted orientations. For example, in the embodiment shown in FIG. 3, combustion receptacle 200 is defined by tubular structure 300 at first end 302 of the tubular structure. This combustion receptacle is orientated relative to the device such that it has no upright or inverted orientation. Therefore when the device is moved between upright and inverted orientations, any smokable material in the receptacle will not be dumped out. In addition, prior to its use, smokable material may be pressed or compacted into the combustion receptacle to further reduce the chance of it falling out during use. Furthermore, in this embodiment, tubular structure 300 can comprise first and second tubular portions, 310 and 312, respectively, which may be joined in any suitable manner. In at least one embodiment, first and second tubular portions 310 and 312 can be releasably joined, for example for ease of cleaning, or for storage or transport of the device. In addition, second tubular portion 312 can be made of a heat resistant material so that it is not damaged when a flame or other heat source is applied at combustion receptable 200.

Figure 4A:
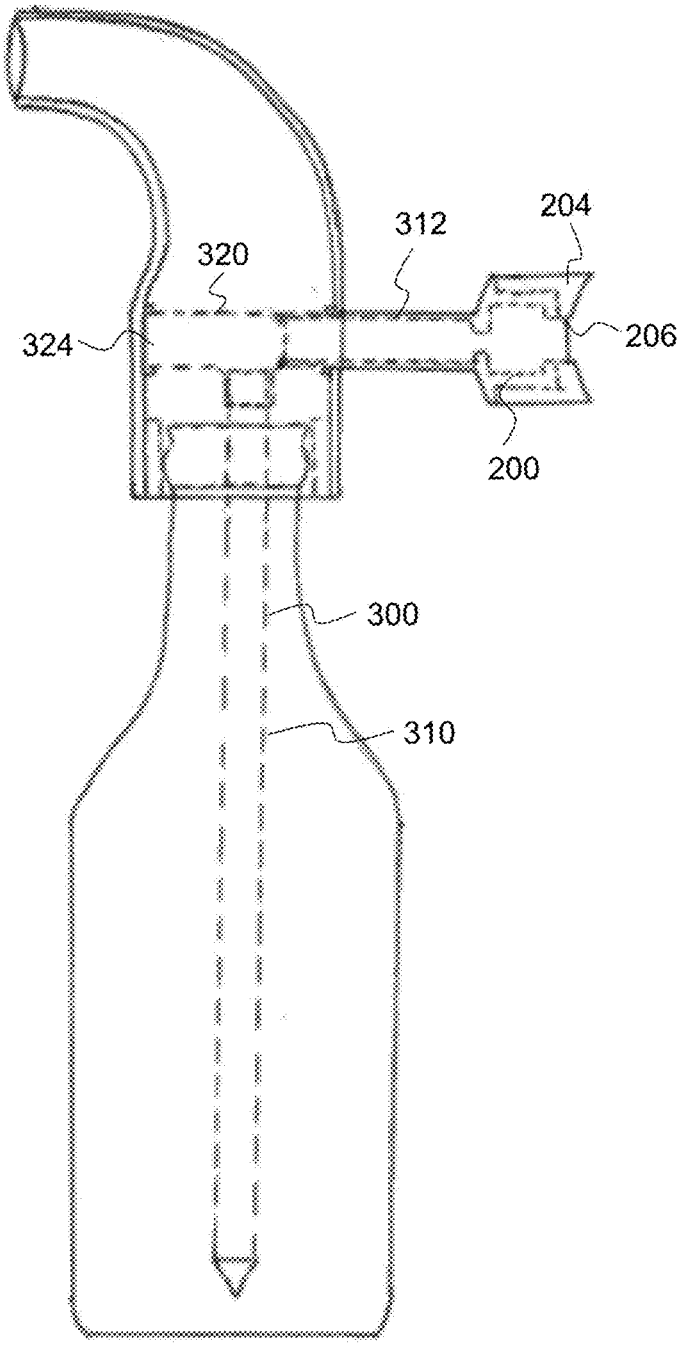
FIG. 4A is a side view of another embodiment of the present device.
Figure 4B:
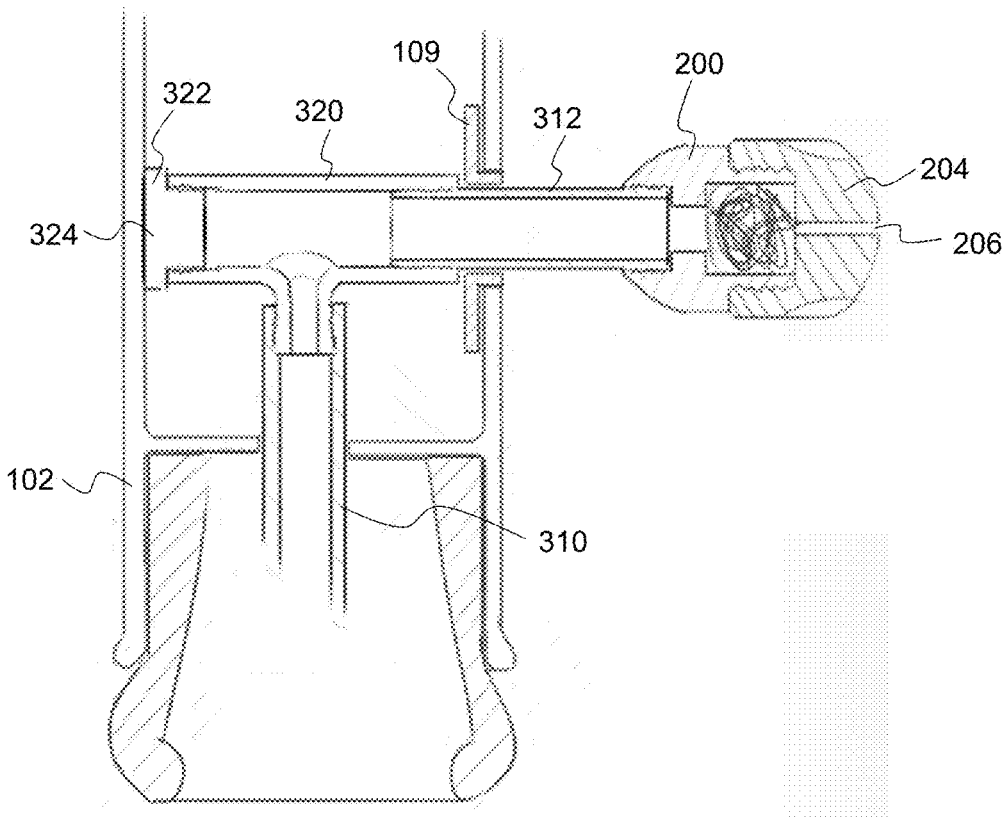
FIG. 4B is a close-up side cross sectional view of the inlet end of the body of another embodiment of the present device.

FIGS. 4A and 4B show embodiments that are adapted for easy disassembly and cleaning. FIG. 4A shows an embodiment in which tubular structure 300 comprises first tubular portion 310, second tubular portion 312, and a third tubular portion 320 extending between and joining first and second tubular portions 310, 312. Third tubular portion 320 can extend from, or be joined or connected to first and second tubular portions 310 and 312 in any suitable way. FIG. 4B shows inlet end 102 of an embodiment that is similar to the one shown in FIG. 4A. In at least one embodiment, as shown in FIGS. 4A and 4B, third tubular portion 320 can be T-shaped. First and second tubular portions 310 and 312 can be substantially straight. The straight tubular portions and the T-shaped portion can allow for easier cleaning, for example by the use of a brush to clean the interiors of the tubular portions. As shown in FIG. 4B, the device may also comprise an end cap 322 for sealing one end of third tubular portion 320. In addition, by contacting an inner surface of body 100, end portion 324 can stabilize and support tubular portion 300 within body 100. Furthermore, device can comprise sealing 109 at opening 108 in body 100. In at least one embodiment, sealing of the device can be or comprise silicone.

In addition, as shown in the Figures, in at least one embodiment tubular structure 300 extends to or proximate a bottom surface 804 of container 800 when device 20 is engaged with the container so that when the container is inverted and smoke is drawn into the container, the amount of smoke that passes through the liquid as it exits second end 304 of tubular structure 300 is minimized. As shown in FIG. 2, second end 304 of tubular structure 300 is located proximate bottom surface 804 of the container. As liquid flows out of the container through body 100, smoke is drawn into the container by the negative pressure created within the container. The smoke travels from combustion receptacle 200 through tubular structure 300, and exits the tubular structure at second end 304. When second end 304 is positioned at or near bottom surface 804 of the container, smoke exiting tubular structure 300 may pass through liquid in the container only when the level of the liquid is above second end 304 of the tubular structure. Once the liquid level drops below second end 304, the smoke exiting the tubular structure will not pass through any liquid. This is desirable in instances where the user wants to minimize the amount of liquid that comes into contact with the smoke within the container. In other words, the user may not want the consumable liquid to filter the smoke exiting out of tubular structure 300 due to undesirable taste effects and/or the production of excess foam.

In one or more other embodiments, tubular structure 300 can contact bottom surface 804 of the container. In at least one embodiment, it is preferable that second end 304 does not become substantially blocked by either bottom surface 804 or side surface 808 of the container. In some embodiments, tubular structure 300 can be adapted to prevent blockage of its second end 304. For example, in at least one embodiment, second end 304 can comprise one or more perforations therethrough (not shown). In one embodiment, perforations can be spaced around the circumference of second end 304. In another embodiment, end portion 316 (see FIG. 1) of second end 304 can be suitably shaped to prevent its blockage by the bottom or side surface of the container.

In addition, in certain embodiments, as smoke is being drawn into the container, the travel of smoke through the portion of tubular structure 300 that is in contact with liquid in the container can result in the cooling of the smoke.

Furthermore, in at least one embodiment, device 20 can comprise means for selectively adjusting the length of tubular structure 300. For example, as shown in FIG. 6, tubular structure 300 can comprise an extension mechanism 308 disposed between opening 108 and second end 304 of the tubular structure. Extension mechanism 308 can be in any suitable form, for example a tubular structure having accordion-like walls for extension and retraction. In another embodiment, extension mechanism 308 can be in the form of a telescoping structure, for example where one tubular portion is received into another tubular portion to lengthen and shorten tubular structure 300. Other types of extension mechanisms are possible. In addition, in at least one embodiment, mechanism 308 can be flexible to allow for tubular structure 300 to be folded upon itself for compact storage.

In one or more other embodiments, the position of tubular structure 300 within body 100 can be selectively adjustable, meaning the tubular structure can be slid relative to the body to adjust the distance by which the tubular structure extends outwardly from inlet end 102 of the body.

In addition, device 20 can comprise one or more mechanisms for preventing the travel of liquid in the container into combustion receptacle 200 through tubular structure 300, but allowing for the travel of smoke from the combustion receptacle into the container. This is particularly desirable when the container is partly or full inverted as the liquid would otherwise extinguish or partially extinguish the burning smokable material. In one or more embodiments, the mechanism can be in the form of a valve mechanism 306. In at least one embodiment, valve mechanism 306 can be a one-way valve mechanism. Furthermore, valve mechanism 306 can be positioned at any suitable position at tubular structure 300. For example, in one or more embodiments, valve mechanism 306 can be located at second end 304 of tubular structure 300 to prevent or limit the ingress of liquid into the tubular structure. Furthermore, as shown best in FIG. 6, valve mechanism 306 can be in the form of a duckbill valve. However, it is to be appreciated that valve mechanism 306 can take any other suitable form, including but not limited to a check valve and a ball valve.

The one or more mechanisms for preventing the travel of liquid in the container into combustion receptacle 200 can take other forms. For example, in one embodiment, tubular structure 300 can comprise a nozzle or filter that will allow smoke to pass therethrough but will block the passage of liquid. In at least another embodiment, for example the embodiment shown in FIGS. 1 and 2, device 20 can comprise a valve mechanism that is actuated by way of the rotation of second tubular portion 312 relative to first tubular portion 310. For instance, the valve mechanism can be closed when second tubular portion 312 is in the orientation shown in FIG. 1, possibly during the process of inserting tubular structure 300 into the container. This can prevent or limit the amount of liquid that enters tubular structure 300 through second end 304 when tubular structure 300 is inserted into liquid in the container. The valve mechanism can be open when second tubular portion 312 is in the orientation shown in FIG. 2, thereby allowing smoke from combustion receptacle 200 to be drawn into the container. The above are only examples and are not meant to be limiting. Mechanisms for preventing the travel of liquid from the container into combustion receptacle 200 can take other suitable forms.

Figure 5B:
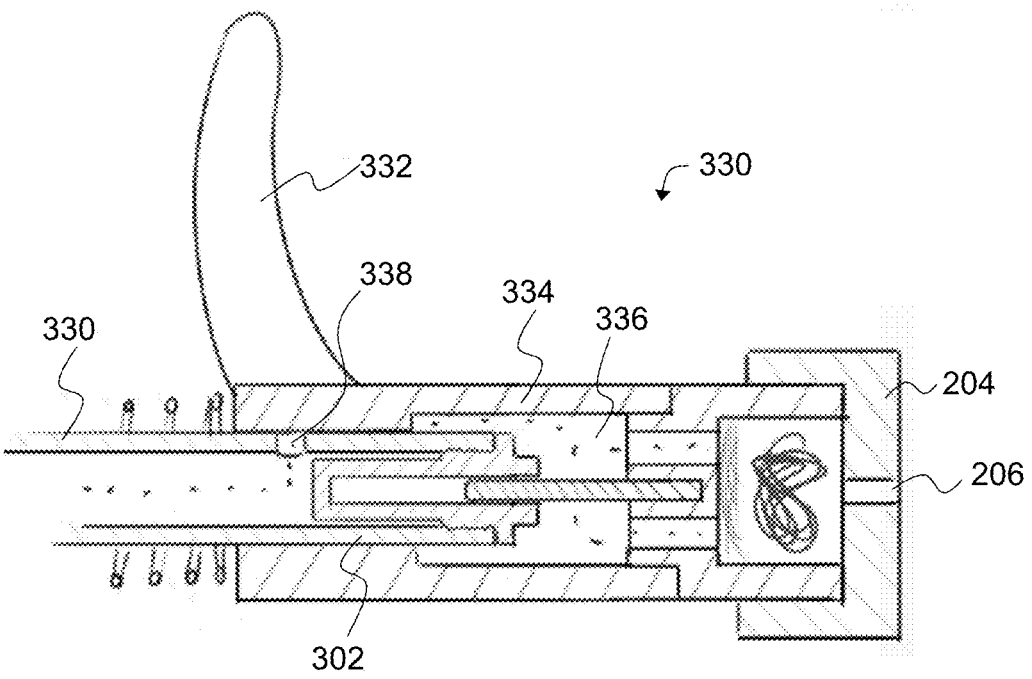
FIG. 5B is a close-up more detailed side view of the shotgunning valve mechanism of the embodiment shown in FIG. 5A.

As shown in FIGS. 5A and 5B, the device may also comprise a shotgunning valve mechanism 330 for selectively opening and closing the fluid passageway defined by tubular structure 300. Shotgunning valve mechanism 330 can be used to close off tubular structure 300 until a time when a user is ready to use the device, for example once the container is inverted and smokable material is being or has just been combusted. At this point in time, a user can actuate shotgunning valve mechanism 330 to open tubular structure 300. This will allow smoke from combustion receptacle 200 to be drawn into the container as liquid flows out of the container through body 100. Shotgunning valve mechanism 330 can be disposed between combustion receptacle 200 and opening 108 in body 100. In at least one embodiment, as shown in FIG. 5B, shotgunning valve mechanism 330 can comprise a movable sleeve 334 that is disposed at first end 302 of tubular structure 300. Sleeve 334 can define a chamber 336, and sleeve 334 can be moved relative to tubular structure 300 such that chamber 336 is moved into and out of alignment with one or more openings 338 defined in first end 302 of tubular structure 300. FIG. 5B shows chamber 336 out of alignment with opening 338 such that chamber 336 is not in fluid communication with opening 338. This prevents the ingress of smoke and or air from combustion receptacle 200 into tubular structure 300. During use of the device, sleeve 334 can be moved or slid along first end 302 of tubular structure 300 (towards the left in FIG. 5B) to align chamber 336 with opening 338 thereby allowing smoke and or air to be drawn into tubular structure 300 through combustion receptacle 200. Furthermore, in at least one embodiment, shotgunning valve mechanism 330 can be designed to simultaneously open a valve (not shown) at outlet end 104 of body 100 such that liquid can be retained within the body until shotgunning valve mechanism 330 is activated, even when device 20 is inverted. In at least one embodiment, shotgunning valve mechanism 330 can be biased, and possibly resiliently biased, in one of a closed position and an open position. Furthermore, in at least one embodiment, shotgunning valve mechanism 330 can comprise a trigger 332 for actuating mechanism 330.

Combustion receptacle 200 can take any suitable form. The receptacle can be open-topped or open-ended such as those in the embodiments shown in FIGS. 1 to 3. In one or more other embodiments, such as those shown in FIGS. 4A, 4B, 5B and 6, combustion receptacle 200 can comprise a removable cover 204 for retaining smokable material therein. Removable cover 204 can be in any suitable form, including a cap and a screen. In addition, cover 204 can define at least one opening 206 therethrough to allow for the ingress of air into the receptacle. At least one opening 206 can be in any suitable form, including but not limited to a hole and a screen. Opening 206 can also allow for the ingress of a flame or other ignition source into combustion receptacle 200. Removable cover 204 can be releasably secured to combustion receptacle 200 in any suitable way, including but not limited to a screw-on connection, a snap-on connection, and a friction fit connection.

In addition, device 20 can comprise means for preventing or limiting any smokable material or ash located in combustion receptacle 200 from traveling into tubular structure 300. In at least one embodiment, such means can be in the form of a screen, such as a metallic screen, and can be positioned in the fluid passageway between combustion receptacle 200 and tubular structure 300. Other means for preventing or limiting smokable material or ash located in combustion receptacle 200 from traveling into tubular structure 300 are possible.

In at least one embodiment, combustion receptacle 200 can be part of a standalone smoking apparatus, such as a smoking pipe. Device 20 can therefore be adapted to mate with a smoke outlet portion of the standalone smoking apparatus, for example a mouthpiece of a pipe. For example, first end 302 of tubular structure 300 can be adapted to mate with the standalone device.

Furthermore, in at least one embodiment, combustion receptacle 200 can be releasably connected to tubular structure 300. This can be useful during use of the device, for example, when a user has consumed most or all of the liquid and is attempting to clear out (e.g. inhale) the smoke from the container. The detachment of combustion receptacle 200 can increase the airflow into the container and thereby assist in venting the container. A detachable combustion receptacle can also be useful when cleaning device 20, or for disassembling the device for storage or transport.

One or more possible uses of one or more embodiments of device 20 are now described.

Container will be fully or partly full of a liquid, in most instances of a drinkable liquid. Smokable material will be placed in combustion receptacle 200. Device 20 will be engaged to the container. A flame or other ignition source will be put to the smokable material to combust the material. A user can then put his or her mouth to outlet end 104 of body 100. The container, and thus device 20, which is engaged with the container, is then inverted or at least partially inverted. Of course it is to be appreciated that the order of some of the preceding steps can be changed without significantly altering the use of the device. Once the device and container are partially inverted or inverted, liquid will then flow into fluid passage 106 of body 100. The user may then allow the liquid to flow out of outlet end 104 of the body, in most instances into the user's mouth. Alternatively, the user may hold their mouth to outlet end 104 without opening their mouth or without swallowing, thereby preventing outflow of liquid from the device until he or she is ready. When smoking material in combustion receptacle 200 is combusted and the container is inverted, the outflow of liquid from the container through body 100 creates negative pressure within the container, thereby drawing in smoke from combustion receptacle 200 through tubular structure 300. Once most or all of the liquid has flowed out of the container, the user may then inhale the smoke in the container through the body. In this way, the present device can provide for the consecutive consumption of liquid from a container and of smoke that has been drawn into the container. The foregoing description of one possible use of device 20 is only an example is not meant to be limiting. Device 20 may be used in one or more different ways.

Some other features of device 20 are now described.

Body 100 can comprise a flow valve mechanism (not shown) for limiting or preventing the flow of liquid out of outlet end 104 of the body. A flow valve mechanism can be useful for preventing the outflow of liquid when the container has been inverted until a time at which a user is ready to begin consuming the liquid.

In addition, body 100 can define a vent opening therethrough (not shown) extending from fluid passage 106 of body 100 to the exterior of the body. The vent opening can facilitate the clearing of smoke from the container and body 100. However, during use of device 20, it can generally be desirable for the vent opening to be closed or blocked, for example by a finger of a user or a valve operated by the user, until most or all of the liquid in the container has flowed out of the container and body 100, otherwise liquid can flow out of the vent opening.

Furthermore, in one or more embodiments, two or more of the components of device 20 can be releasably connected. One or more releasable connections between components can be useful for cleaning the device, as well as for disassembling the device for storage or transport purposes. In at least one embodiment, one or more components can be detached and stored within body 100 of the device.

The embodiments described herein are examples of structures or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed:

1. A device for use with a liquid container having an opening and containing liquid, the device comprising:

a body having an inlet end and an outlet end, and defining a fluid passage between the inlet end and the outlet end, the inlet end is aligned with and substantially sealingly engaged with the container to provide fluid communication between the opening of the container and the fluid passage of the body, the outlet end extending away from the opening of the container and being transverse to a longitudinal axis of the container, the body further defining an opening therethrough, the opening being different than the fluid passage;

a combustion receptacle for receiving smokable material, and for allowing the combustion of the smokable material therein; and a tubular structure for allowing the travel of smoke from the combustion receptacle into the container, the tubular structure having a first end and a second end and extending at least from the opening in the body outwardly from the inlet end of the body such that said first end extends transversely to the longitudinal axis of the container and in a direction opposite to the outlet end of the body, the first end being in fluid communication with the combustion receptacle, and the second end extending into the container when the device is engaged with the container.

2. The device of claim 1 wherein when the device is engaged with the container, when the container and device are at least partially inverted, and when the smokable material is combusted in the combustion receptacle, egress of the liquid from the container into the fluid passage of the body causes smoke from the combustion receptacle to be drawn into the container through the tubular structure.

3. The device claim 1 wherein when the device is engaged with the container, the second end of the tubular structure is disposed at or proximate to a bottom surface of the container so that when the container is inverted and smoke is drawn into the container, the amount of smoke that passes through the liquid as it exits the tubular structure is minimized.

4. The device of claim 1 further comprising a one-way valve mechanism for preventing travel of the liquid in the container into the combustion receptacle but allowing for the travel of fluid from the combustion receptacle into the container.

5. The device of claim 4 wherein the one-way valve mechanism is disposed at the second end of the tubular structure, thereby preventing ingress of the liquid into the tubular structure.

6. The device of claim 5 wherein the one-way valve mechanism is in the form of a duckbill valve, a check valve, or a ball valve.

7. The device of claim 1 wherein the orientation of the combustion receptacle is maintained in an upright position as the container is moved between a non-inverted orientation and an inverted orientation.

8. The device of claim 7 wherein the tubular structure extends outwardly from the body through the opening in the body, and at least a portion of the tubular structure extending outwardly from the body is flexible with minimal force by hand to enable the orientation of the combustion receptacle to be maintained in the upright position as the container is moved between the non-inverted orientation and the inverted orientation.

9. The device of claim 7 wherein the tubular structure extends outwardly from the body through the opening in the body, the tubular structure comprising at least a first tubular portion and a second tubular portion, at least part of the second tubular portion being located outwardly of the body, the second tubular portion being disposed between the first tubular portion and the combustion receptacle, the second tubular portion being rotatably and sealingly engaged to the first portion.

10. The device of claim 1 wherein the distance by which the tubular structure extends outwardly from the inlet end of the body is selectively adjustable.

11. The device of claim 10 wherein the tubular structure comprises an extension mechanism disposed between the opening in the body and the second end of the tubular structure, the extension mechanism allowing for the selective adjustment of the length of the tubular structure.

12. The device of claim 1 wherein the combustion receptacle comprises a removable cover for retaining the smokable material therein, the combustion receptacle defining at least one opening therethrough to allow for the ingress of air into the receptacle.

13. The device of claim 1 wherein the combustion receptacle is defined by and disposed at the first end of the tubular structure.

14. The device of claim 1 wherein the combustion receptacle is releasably connected to the tubular structure.

15. The device of claim 1 further comprising a shotgunning valve mechanism for selectively closing and opening the fluid passageway defined by the tubular structure.

16. The device of claim 15 wherein the shotgunning valve mechanism is disposed between the combustion receptacle and the opening in the body.

17. The device of claim 15 wherein the shotgunning valve mechanism is resiliently biased in one of a closed position and an open position.

18. The device of claim 1 wherein the body is releasably secured to the container to maintain the sealing engagement of the inlet end of the body with the container.

19. The device of claim 18 wherein the inlet end of the body is releasably secured to the container by way of one of a friction fit, a snap fit, or a twist-on fit.

20. The device of claim 1 wherein the body comprises a flow valve mechanism for limiting or preventing the flow of liquid out of the outlet end of the body.

21. The device of claim 1 wherein the body defines a vent opening therethrough extending from the fluid passage of the body to the exterior of the body, the vent opening facilitating the clearing of smoke from the container and fluid passage of the body.

* * * * *